United States Patent [19]

Klein et al.

[11] Patent Number: 4,588,878

[45] Date of Patent: May 13, 1986

[54] MOLDED CASE CIRCUIT BREAKER WITH REDUCED CONTACT MOUNTS

[75] Inventors: Keith W. Klein, Simsbury; David Arnold, Old Saybrook, both of Conn.

[73] Assignee: General Electric Company, New York, N.Y.

[21] Appl. No.: 672,214

[22] Filed: Nov. 16, 1984

[51] Int. Cl.[4] ..... H01H 3/46

[52] U.S. Cl. ..... 200/153 G; 200/327

[58] Field of Search ..... 200/153 G, 327, 153 H, 200/153 SC, 318, 323, 324, 153 L, 153 LA, 153 LB, 325

[56] References Cited

U.S. PATENT DOCUMENTS

| | | | |
|---|---|---|---|
| 3,003,046 | 10/1961 | Torre | 200/153 G |
| 3,155,803 | 11/1964 | Klein et al. | 200/153 G |
| 3,158,716 | 11/1964 | Koval | 200/153 G |
| 3,265,833 | 8/1966 | Murphy | 200/293 |
| 3,286,067 | 11/1966 | Menickella et al. | 200/153 G |
| 3,621,189 | 11/1971 | Link | 200/153 G |
| 4,001,742 | 1/1977 | Jencks et al. | 200/153 G |
| 4,245,140 | 1/1981 | Jencks et al. | 200/153 G |

*Primary Examiner*—Stephen Marcus
*Assistant Examiner*—Linda J. Sholl
*Attorney, Agent, or Firm*—Richard A. Menelly; Walter C. Bernkopf; Fred Jacob

[57] ABSTRACT

A molded case industrial circuit breaker is provided with a shortened contact separation distance upon manual operation to reduce the stresses imposed upon the breaker operating mechanism when the breaker is manually operated to open or close the contacts. A camming surface is provided on the cradle operator to provide a stop for the toggle pin both upon opening as well as upon closing the contacts. The decreased separation which occurs between the contacts upon manual operation allows a savings in the amount of contact braid material as well as reducing the size of both the fixed and movable contacts. The decreased stresses on the mechanism correspondingly allows for a reduction in the material strength and mass of the breaker flexible connectors, operating springs, and contacts.

3 Claims, 3 Drawing Figures

MOLDED CASE CIRCUIT BREAKER WITH REDUCED CONTACT MOUNTS

BACKGROUND OF THE INVENTION

Molded case circuit breakers for industrial application are described within U.S. Pat. No. 3,155,803 entitled "Electric Circuit Breaker With Toggle Positioning Means" in the name of Keith W. Klein and David B. Powell. This patent describes a toggle operating mechanism which consists of a pair of upper and lower links joined together by a toggle pin. To set the alignment of the upper links when the circuit breaker contacts are closed, the cradle is provided with a stopping surface at the forward end of the cradle to receive the toggle pin when the operating handle is moved to the ON position. The angle defined between the upper and lower links is maintained slightly less than 180° to allow manual opening of the contacts without undue resisting force.

The advent of rapid operating mechanisms within industrial size molded case circuit breakers allows the circuit to be interrupted in a time during the current waveform before the current amplitude has reached a maximum value. The following U.S. patent applications describe various operating mechanisms and contact arm configurations which accomplish the rapid contact separation without requiring a re-design of the other breaker components. U.S. patent application Ser. No. 479,616 filed Mar. 28, 1983 now U.S. Pat. No. 4,480,242 entitled "Variable Torque Contact Arm For Electric Circuit Breakers"; U.S. patent application Ser. No. 479,617 filed Mar. 28, 1983 now U.S. Pat. No. 4,482,877 entitled "Electric Circuit Breakers Having Fast Short Circuit Response"; and U.S. patent application Ser. No. 609,053 filed May 10, 1984 now U.S. Pat. No. 4,553,119 entitled "Electric Circuit Breaker Having Reduced Arc Energy" all in the names of R. Castonguay and C. Jencks. These patent applications are incorporated herein for purposes of reference.

To facilitate such rapid contact separation, an S-shaped contact arm configuation is generally required. It was discovered during excessive high current test conditions, that the separating contacts would arc at the approximate location at which the contacts would mate upon closing. This could cause localized contact heating upon repeated opening and closing of the contacts under excessive current test conditions eventually causing the silver contact material to melt and fuse the contacts.

It was further discovered that the same contact arm configuration allowed the contacts to separate to an approximate 90° angle measured between the upper and lower links resulting in a large separation distance between the contacts when the contacts are manually opened to set the operating mechanism. When the contacts were summarily closed, the force required to overcome the large separation distance caused the movable contact to strike the fixed contact with a substantial velocity causing the movable contact to bounce away from the fixed contact. This "contact bounce" between energized breaker contacts could cause localized arcing between the contacts increasing contact wear as well as providing contact weld as described earlier.

The purpose of this invention is to provide means for setting the contact separation distance upon manual opening of the contacts to thereby substantially reduce the stress on the mechanism and the occurrence of contact bounce and contact welding upon manual closing of the contacts.

SUMMARY OF THE INVENTION

A molded case circuit breaker operating mechanism cradle is provided with a stopping surface for the operating mechanism toggle pin during manual opening and closing of the breaker contacts. The stopping surface behaves as a cam to direct the toggle pin as a cam-follower. The stopping surfaces accurately set the angle of the upper and lower links joined by the toggle pin to facilitate manual opening and closing of the contacts with substantially reduced contact bounce.

DESCRIPTION OF THE PREFERRED EMBODIMENT

Figure 1:
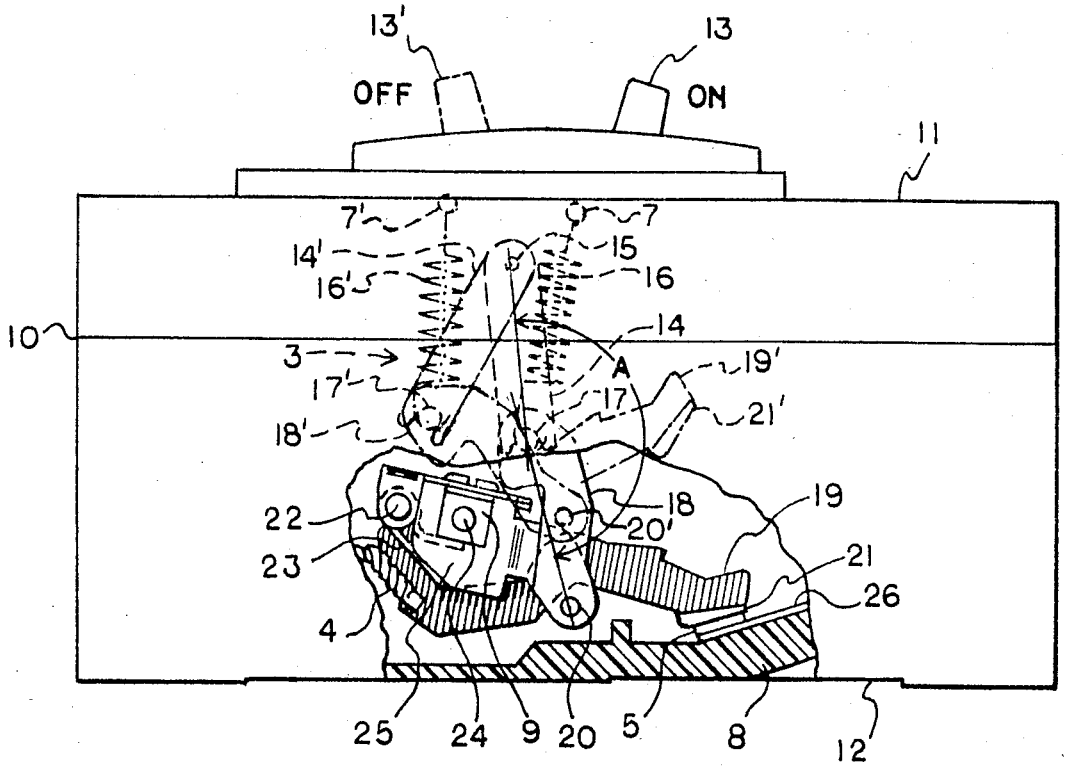
FIG.1 (PRIOR ART)
FIG. 1 is a side view of a molded case circuit breaker with part of the casing removed to expose the lower portion of the contact operating mechanism.
Figure 2:
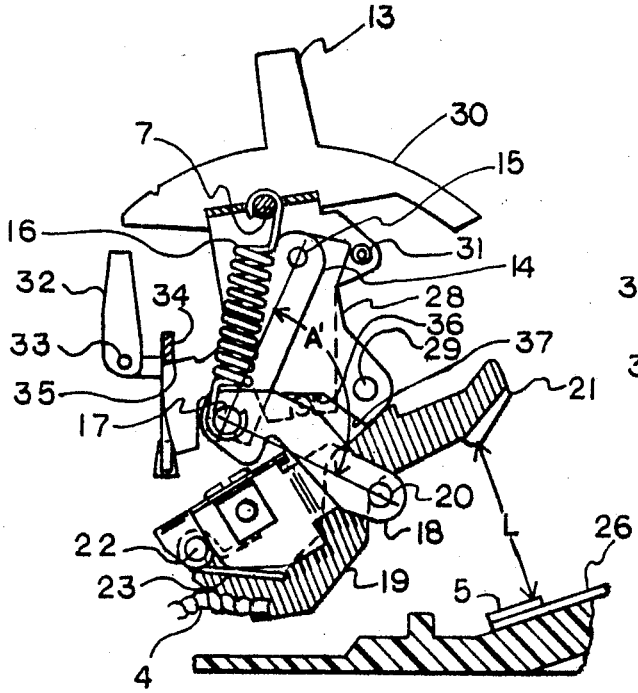
FIG.2 (PRIOR ART)
FIG. 2 is a side view of a portion of the operating mechanism used within the breaker depicted in FIG. 1.

A molded case industrial circuit breaker 10 is shown in FIG. 1 wherein a cover 11 is arranged on a case 12 manufactured from a thermoset plastic material. An ON-OFF handle 13 wherein the OFF position 13' is shown in phantom is mounted to the top of the cover and an upper link 14 having an upper pin 15 is pivotally connected to a lower link 18 having a lower pin 20 by means of a toggle pin 17. The arrangement of the upper and lower links 14, 18 comprise the toggle mechanism generally described at 3. An operating spring 16 fixedly attached to a portion of the operating handle apron 30 as shown in FIG. 2 by means of a support 7 operatively connects to the toggle operating mechanism 3 by connection to the toggle pin 17 at its opposite end. As described in the aforementioned patent to K. W. Klein et al., the movement of the operating handle transposes the movable contact arm 19 from the closed position indicated wherein the movable contact 21 touches the fixed contact 5 to the open position identified as 19' with the movable contact indicated as 21'. The movable contact arm 19 is supported on a contact carrier 25 and secured thereto by means of pivot pin 22 and support pin 20 to allow the movable contact arm to rotate about the contact carrier pivot 24 when the handle is moved from the ON to the OFF position. As fully described within the referenced patent applications, a contact spring 23 is arranged around the movable contact arm pivot 22. Electrical connection with the movable contact arm is made by means of braided conductor 4. Electrical connection with the fixed contact 5 is made through the contact strap 26 supported upon the insulated base 8. The movable braided conductor 4 is fixedly attached to the circuit breaker load terminal (not shown) at the opposite end and is provided with a length in excess of the separation distance between the line terminal and the movable contact arm to allow sufficient flex upon movement of the movable contact arm without breaking the braid connection at either end. The braid is further provided with a diameter in excess of that necessary to meet the steady state current operating conditions in order to provide sufficient mass to prevent the braid from undergoing a whipping movement when the movable contact is moved to the open position either manually or upon operation of the circuit breaker trip unit.

The latch assembly consists of a secondary latch 32 pivoted about a secondary latch pin 33 and a primary latch 34 which contains a latch surface 35 for removably retaining a portion of the cradle 28. It is noted that the handle 13 is in its OFF position such that the operating spring 16 is in an unstressed condition and the angle A′ defined between the upper and lower links 14, 18 is equal to or less than 90°. The separation distance between the movable contact 21 and the fixed contact 5 is defined by L. The cradle operating member 28 is shown to contact a handle pin 31 on the handle apron 30 when the circuit breaker is moved to its OFF position and the cradle rotates in a counterclockwise direction about the cradle pivot 29. In the counterclockwise rotation of the cradle, the toggle pin 17 has moved from a stop 37 formed on the cradle as described within the Klein et al. Patent and has moved within the toggle pin clearance area generally described at 36 to a position of rest within the clearance area. The large contact separation distance L generates the high movable contact arm velocity described earlier, and necessitates the increased length and crossectional area of the braided conductor 4.

Figure 3:
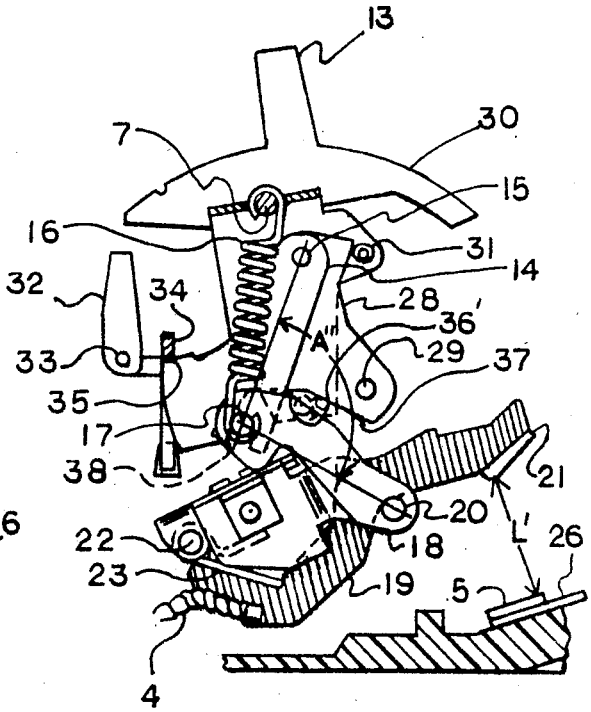
FIG. 3 is a side view of a portion of the operating mechanism according to the invention.

The improved operating mechanism arrangement according to the instant invention is shown in FIG. 3 to consist of a similar handle 13 shown in the OFF position with the handle pin 31 in contact with a portion of the cradle 28 and with the cradle rotated in a counterclockwise direction about the cradle pivot 29. It is noted that the angle A″ defined between the upper and lower links 14, 18 is now less than 180° but larger than that shown at A′ for the operating mechanism depicted earlier in FIG. 2. The contact separation distance L′ is substantially less than the contact separation distance L shown in FIG. 2. This is brought about by the movement of the toggle pin 17 from the stop 37 formed on the surface of the cradle 28 to set the angle of the upper and lower links 14, 18, when the contacts are closed, through a new clearance area 36′ formed on the cradle 28 to a second stop position 38 formed on the cradle opposite that of the first stop 37. This prevents the movable contact arm 19 from any further counterclockwise rotation and thereby sets both linkage angle A″ as well as the contact separation distance L′. Since the braided conductor 4 no longer has to travel as great a distance its length can be decreased by approximately 15% without adversely affecting either the electrical or mechanical properties. The reduced counterclockwise movement of the movable contact arm 19 also allows a reduction in the diameter of the braided conductor which accounts to an overall decrease of roughly 30% in the weight of the braided conductor. Besides providing increased contact operating life by avoiding contact bounce, the careful control of the contact separation distance also provides a substantial savings in the copper material used to form the braided conductor. Additionally, a substantial savings in fabrication cost of the braided conductor is provided by reducing the flex exerted on the braided conductor and allowing the use of a #36 AWG size wire as opposed to a #44 AWG size wire in the braid construction. The reduced energy in the "off" operation because of the reduced shock, or bounce, also allows use of lower trip bar return spring force and lower primary latch engagement without nuisance trip. An additional feature resulting from the careful control over the contact separation distance when the breaker is in the OFF position, is the use of a smaller area for the movable and fixed contacts 21, 5. This allows for more silver to be employed within both of the contacts to cause a further reduction in the contact operating temperatures because of the good electrical and thermal conduction properties of silver. When such contacts are operated within the operating mechanism shown in FIG. 3 the toggle pin 17 moves between the cradle stop 37 with the contacts in the closed position along the surface provided by the clearance area 36′ to the stop 38 provided on the cradle surface for governing the contact separation distance L′ when the handle is in the OFF position. This is similar to the operation of a cam within a cam-follower whereas the cam is defined by the location of the two stops 37, 38 provided on the clearance area 36′ on the surface of cradle 28. The location of stops 37, 38 accurately define the contact separation distance L′ and the angle A″ defined between the upper and lower links 14, 18, as described earlier.

Having described our invention, what we claim as new and desire to secure by Letters Patent is:

1. An improved operating mechanism for electric circuit interrupters of the type consisting of a spring actuated toggle mechanism and a pair of electric contacts wherein an upper link and a lower link pivotally joined by a toggle pin releasably support a movable contact arm, and an operating handle moves the movable contact arm between ON and OFF positions by connection with an operator cradle, the improvement comprising: an operator cradle consisting of a body member having three planar extensions, a first of said planar extensions having means pivotally supporting said upper link, a second of said planar extensions having means pivotally supporting said cradle body member and a third of said planar extensions having means defining:

a first stop formed on a surface of said third planar extension for capturing said toggle pin when said operating handle is moved to the OFF position to limit movement of said movable contact arm and to provide a predetermined separation distance between said pair of electric contacts, and a second stop formed on said second planar extension for capturing said toggle pin when said operating handle is moved to the ON position to provide a predetermined angle between said upper and lower links when said operating handle is in the ON position.

2. The improved operating mechanism of claim 1 wherein, said predetermined angle is greater than 90° and less than 180° for setting said predetermined distance between said pair of electric contacts.

3. The improved operating mechanism of claim 1 including a camming surface on said cradle body extending between said second and said third planar extensions for capturing said toggle pin between said second and first stops during movement of said operating handle from the ON to the OFF position.

* * * * *

UNITED STATES PATENT AND TRADEMARK OFFICE

CERTIFICATE OF CORRECTION

PATENT NO. : 4,588,878

DATED : 5/13/86

INVENTOR(S) : Klein et al.

It is certified that error appears in the above-identified patent and that said Letters Patent is hereby corrected as shown below: Title page:

IN THE TITLE:

Please amend the title to read: MOLDED CASE CIRCUIT BREAKER WITH REDUCED CONTACT BOUNCE

Signed and Sealed this

Nineteenth Day of June, 1990

*Attest:*

HARRY F. MANBECK, JR.

*Attesting Officer*

*Commissioner of Patents and Trademarks*